US007201514B2

(12) United States Patent
Andrews

(10) Patent No.: US 7,201,514 B2
(45) Date of Patent: Apr. 10, 2007

(54) FLUID CONNECTION ASSEMBLY FOR X-RAY DEVICE

(75) Inventor: Gregory C. Andrews, Draper, UT (US)

(73) Assignee: Varian Medical Systems Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/954,042

(22) Filed: Sep. 29, 2004

(65) Prior Publication Data

US 2006/0067482 A1 Mar. 30, 2006

(51) Int. Cl.
*H01J 35/12* (2006.01)

(52) U.S. Cl. ..... 378/199; 378/200

(58) Field of Classification Search ..... 378/119, 378/130, 141, 142, 200–203
See application file for complete search history.

(56) References Cited

U.S. PATENT DOCUMENTS 3,181,560 A * 5/1965 Worden et al. ..... 137/494
3,587,642 A * 6/1971 Gotzenberger ..... 137/614.21
5,313,512 A * 5/1994 Tanaka ..... 378/200
6,075,839 A 6/2000 Treseder
6,115,454 A 9/2000 Andrews et al.
6,366,642 B1 4/2002 Andrews
6,426,998 B1 * 7/2002 Hell et al. ..... 378/141
6,519,317 B2 2/2003 Richardson et al.
6,519,318 B1 2/2003 Andrews

* cited by examiner

*Primary Examiner*—Edward J. Glick
*Assistant Examiner*—Irakli Kiknadze
(74) *Attorney, Agent, or Firm*—Workman Nydegger

(57) ABSTRACT

A fluid connection assembly is provided for use with x-ray devices. The fluid connection assembly includes an adapter block configured to be attached about an opening in a housing of an x-ray device. The adapter block defines a fluid port and a cylinder in fluid communication with each other. In addition, the fluid connection assembly includes a flow adapter received in a passageway collectively defined by the cylinder of the adapter block and the opening in the housing wall. The flow adapter defines a fluid passageway configured for communication with the fluid port and the interior of the housing of the x-ray device. A sealing element is interposed between the flow adapter and the housing wall. Finally, a resilient element disposed within the cylinder of the adapter block proximate the flow adapter biases the flow adapter into contact with a shield structure inside the housing.

18 Claims, 3 Drawing Sheets

FLUID CONNECTION ASSEMBLY FOR X-RAY DEVICE

BACKGROUND OF THE INVENTION

RELATED APPLICATIONS

Not applicable.

FIELD OF THE INVENTION

The present invention relates generally to x-ray systems, devices, and related components. More particularly, exemplary embodiments of the invention concern systems and devices for communicating a coolant to and from an x-ray device housing, while also reducing system complexity and part counts.

Related Technology

It is the nature of x-ray systems, components and devices that they are routinely required to operate consistently and reliably for long periods of time under extreme thermal conditions. The operational environments for x-ray systems, components and devices are not characterized solely by high temperatures however. X-ray systems must also be able to withstand repeated, and extreme, thermal cycles where the temperature of the x-ray system can change dramatically over a relatively short period of time. Among other things, extreme heat and thermal cycling imposes significant mechanical stress and strain on x-ray system components that can lead to catastrophic failure if the heat generated as a result of x-ray device operations is not reliably and consistently removed. Consequently, various cooling systems have been devised to this end.

In one type of cooling system, a housing is provided that is configured to enclose an x-ray tube insert that includes a cathode and an anode. The housing includes a volume of coolant that is in direct contact with the x-ray tube insert so that as heat is generated as a result of x-ray tube operations, the coolant is able to remove heat from the x-ray tube insert. These cooling systems may also include an external cooling system that circulates the coolant through the housing and removes heat from the coolant before returning the coolant to the housing.

At least some of such cooling systems also provide the ability to direct a flow of coolant to specific x-ray device components. This is accomplished, in at least some instances, through the use of hoses or similar components situated within the housing. More particularly, the hose, or hoses, connect at one end to an opening in a wall of the housing, so as to receive a portion of the flow of coolant from the external cooling system. The other end of the hose is connected with the particular structure or component to be cooled. In this way, a portion of the coolant received from the external cooling system is routed directly to a particular component of interest, thus providing for an enhanced cooling effect for that component, relative to what might otherwise be achieved.

While good results are sometimes obtained with component-specific cooling arrangements such as that just described, the complexity of such systems, and the multiplicity of parts typically employed in such systems, inevitably lead to problems. For example, one such system may employ several different hoses, each of which includes a fluid connector at either end. However, each hose and fluid connector represents a potential failure point in the cooling system, and the multiplicity of parts increases the likelihood that a failure will occur.

The use of multiple parts presents other problems as well. For example, complex cooling systems involving multiple parts are relatively more expensive to produce. Additionally, the use of numerous parts complicates the assembly and testing of the x-ray device and the cooling system. In addition, the maintenance burden associated with such cooling systems is a concern as well. Specifically, the increased maintenance time, such as is necessitated by the complexity of the cooling system, increases the down time of the x-ray device, and also increases the costs associated with operation of the x-ray device.

In view of the foregoing, and other, problems in the art, it would be useful to provide systems and devices that, among other things, facilitate reliable communication of a coolant to and from an x-ray device housing and/or other components, while reducing cooling system complexity and part counts.

BRIEF SUMMARY OF AN EXEMPLARY EMBODIMENT OF THE INVENTION

In general, embodiments of the invention are concerned with systems and devices for communicating a coolant to and from an x-ray device housing while minimizing system complexity and part counts.

One example embodiment of the invention concerns a fluid connection assembly configured for use with x-ray devices. The fluid connection assembly includes an adapter block configured to be attached about an opening in a housing of an x-ray device. The adapter block defines a fluid port and a cylinder in fluid communication with each other. In addition, the fluid connection assembly includes a flow adapter received in a passageway collectively defined by the cylinder of the adapter block and the opening in the housing. The flow adapter defines a fluid passageway configured for communication with the fluid port and the interior of the housing of the x-ray device. A sealing element is interposed between the flow adapter and the housing. Finally, a resilient element disposed within the cylinder of the adapter block proximate the flow adapter biases the flow adapter into contact with a shield structure inside the housing.

In operation, a coolant is introduced into the fluid port and then passed through the fluid passageway defined by the flow adapter and then into the x-ray device housing. In some cases, the coolant may simply enter the housing and contact the x-ray tube insert. In other implementations, the coolant passing through the flow adapter enters an x-ray device shield structure, or aperture, situated within the x-ray device housing. In either case, the coolant is preferably directed into contact with x-ray device components and then circulated out of the x-ray device housing.

Among other things then, embodiments of the fluid connection assembly provide a simple and reliable mechanism for circulating coolant to and from an x-ray device housing and/or other components, while reducing cooling system part count and complexity.

BRIEF DESCRIPTION OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF EXEMPLARY EMBODIMENTS OF THE INVENTION

Reference will now be made to the drawings to describe various aspects of example embodiments of the invention. It should be understood that the drawings are diagrammatic and schematic representations of such exemplary embodiments and, accordingly, are not limiting of the scope of the present invention, nor are the drawings necessarily drawn to scale.

Generally, embodiments of the invention concern a fluid connection assembly that provides a simple and reliable mechanism by way of which coolant can be transferred to, and/or removed from, an x-ray device housing and/or other components, while reducing cooling system part count and complexity. The scope of the invention is not, however, limited to x-ray devices and components.

As discussed more particularly below, some implementations provide for a fluid connection assembly that is connected to a housing of an x-ray device and allows fluid, such as from an external cooling system, to be directed to specific portions of the x-ray device, without necessitating the use of hoses and various other components. In at least some implementations, the fluid connection assembly operates in cooperation with x-ray device structures such as the housing to implement fluid transfer processes.

I. Exemplary Operating Environments

Figure 1:
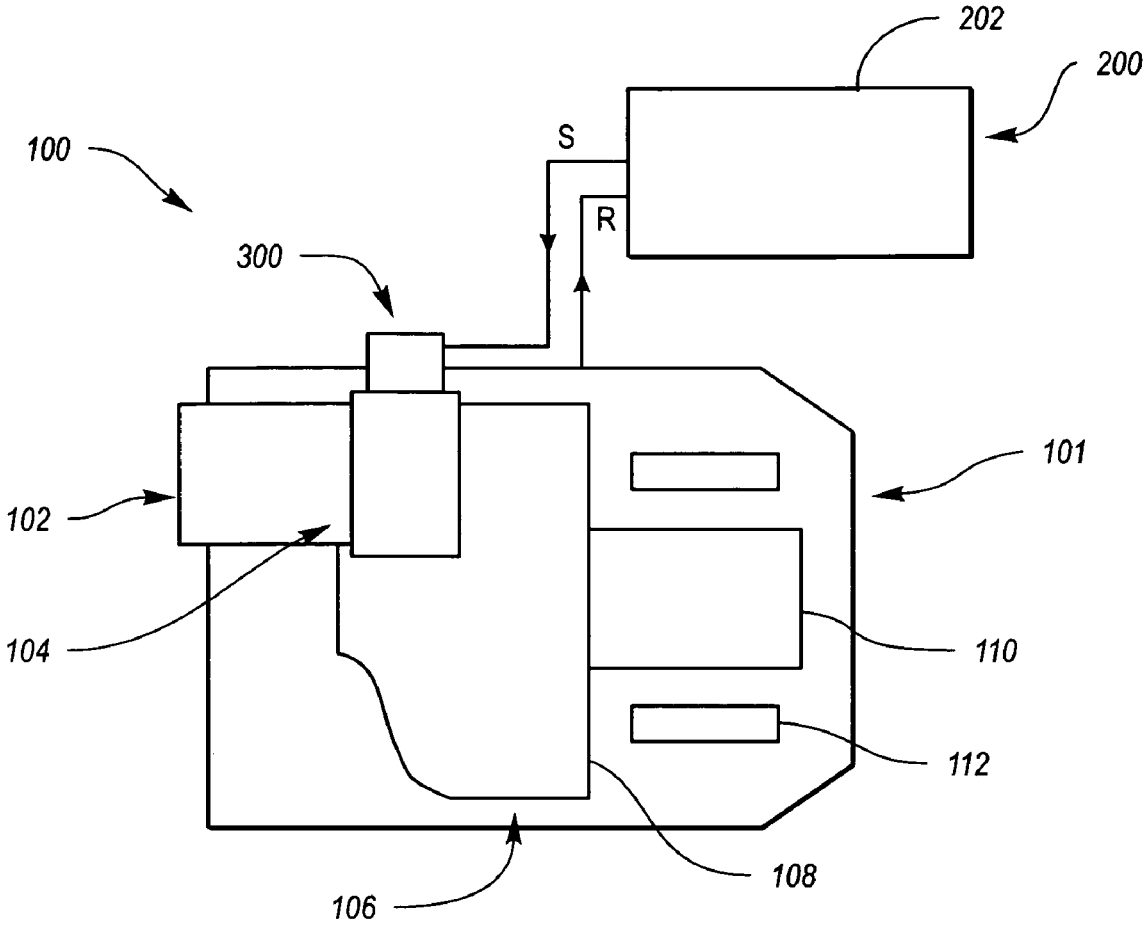
FIG. 1 is top view of an exemplary operating environment in connection with which at least some exemplary embodiments of the invention may be employed.

Directing attention now to FIG. 1, details are provided concerning an exemplary arrangement where an x-ray device 100 is configured and arranged for fluid communication with an external cooling system 200. The x-ray device 100 may, for example, comprise a portion of a medical imaging and diagnostic system, such as a computed topography ("CT") system, or any other type of x-ray system where some or all of the functionality and devices disclosed herein be usefully employed. Examples of such other systems include, but are not limited to, non-destructive test ("DT") systems, radiation therapy systems, and mammogram systems. It should be noted here that at least some embodiments of the invention are particularly well suited for use in connection with anode end grounded x-ray tubes and devices.

Moreover, while various aspects of exemplary embodiments of the invention are discussed in the context of x-ray devices and related components, the scope of the invention is not so limited. Rather, some or all of the aspects of the disclosure hereof may be employed in connection with various other operating environments and devices as well. Accordingly, the scope of the invention is not limited solely to x-ray systems, devices, and components.

The x-ray device 100 includes a housing 101 configured to contain a volume of coolant, at least a portion of which can be removed from the housing 101, and then cooled and recirculate back into the housing, by an external cooling system 200 that includes a cooling unit 202 configured for fluid communication with the x-ray device 100, and with a fluid connection assembly 300 that is attached to the x-ray device 100. In the exemplary implementation of FIG. 1, a coolant supply line ("S") connects the cooling unit 202 with the fluid connection assembly 300, while a coolant return line ("R") line connects the cooling unit 202 with the housing 101.

A cathode assembly 102 of an x-ray tube substantially disposed within the housing 101 and includes an electron source (not shown) configured and arranged to emit electrons which are then directed through a shield structure 104 to an anode assembly 106 of the x-ray tube. The shield structure 104 is in fluid communication with the fluid connection assembly 300 so that, for example, heat generated at the shield structure 104 as a result of the impact of back scattered electrons can be removed by coolant supplied to the shield structure 104 by way of the fluid connection assembly 300. Exemplary embodiments of a shield structure 104 are disclosed and claimed in U.S. Pat. No. 6,115,454 (issued to Andrews et al.), U.S. Pat. No. 6,519,317 (issued to Richardson et al.), and U.S. Pat. No. 6,519,318 (issued to Andrews), each of which is incorporated herein in its respective entirety by this reference.

Similar to the cathode assembly 102, at least a portion of the anode assembly 106 is configured for contact with the coolant disposed in the housing 101: In the illustrated implementation, the anode assembly 106 includes an anode 108 that includes a target surface (not shown), composed of a refractory metal or other suitable material(s), configured to receive electrons emitted by the cathode assembly 102. The anode 108 is attached to a rotor 110 that is rotated at high speed by a stator 112. While the implementation illustrated in FIG. 1 is concerned with a rotating anode type x-ray device, the scope of the invention is not so limited.

In operation, electrons emitted by the cathode assembly 102 impact the target surface (not shown) of the anode 108, so that x-rays are thereby produced. The x-rays are directed through a window (not shown) in the housing 101 and into the x-ray subject. During operation of the x-ray device 100, the cooling unit 202 provides a flow of coolant to the fluid connection assembly 300 by way of the coolant supply line (S). The fluid connection assembly 300 then passes the coolant through the wall of the housing 101 and directly into the shield structure 104, where the coolant removes some of the heat generated in the shield 104 as a result of the x-ray generation process. In at least some implementations, the coolant exits the shield structure 104 and passes into the housing 101. The coolant in the housing 101 ultimately returns to the cooling unit 202 by way of the coolant return line (R).

It should be noted that the arrangement indicated in FIG. 1 is exemplary only, and is not intended to limit the scope of the invention in any way. For example, in some alternative embodiments, coolant is directed from the cooling unit 202, or other system or device, not only to the shield structure 104, but to one or more additional x-ray device components as well. Some or all of such additional x-ray device components are supplied with coolant by way of the fluid connection assembly 300.

In yet other embodiments, no shield structure is provided and the coolant is directed to one or more alternative components, by way of the fluid connection assembly 300. Further still, some embodiments include a shield structure that is cooled externally only, and does not receive a flow of coolant. In such embodiments, the coolant is directed to one or more alternative components by way of the fluid connection assembly 300.

In addition, the various exemplary embodiments noted above, and others, may be configured so that the amount of coolant provided to the x-ray device by way of the fluid connection assembly varies. Thus, in some cases, all of the coolant provided by the cooling unit is supplied to the x-ray device by way of the fluid connection assembly. In yet other cases, only a portion of the coolant provided by the cooling unit is supplied to the x-ray device by way of the fluid connection assembly, with other portions of the coolant being supplied directly to the housing and/or to other components of the x-ray device.

II. Exemplary Embodiments of a Fluid Connection Assembly

Figure 2:
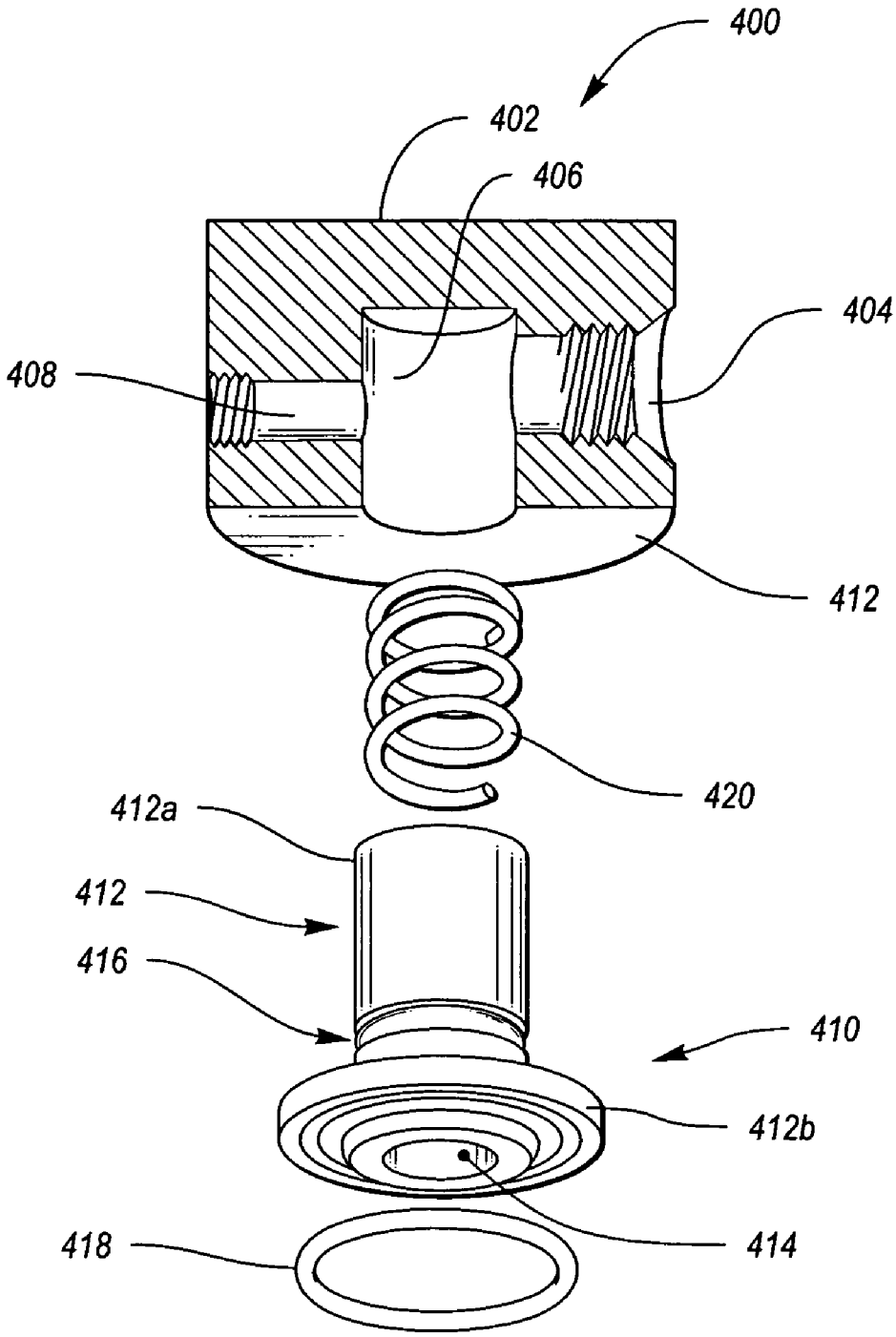
FIG. 2 is an exploded perspective view of an exemplary implementation of a fluid connection assembly.

With attention now to FIG. 2, details are provided concerning an exemplary implementation of a fluid connection assembly, denoted generally at 400. The illustrated embodiment of the fluid connection assembly 400 includes an adapter block 402 that, in some implementations, takes a generally cylindrical form, although other geometries may be employed as well. The adapter block 402 may be permanently, or removably, attached to an x-ray device housing or other structure, by any suitable method, examples of which include welding, gluing or brazing. In some implementations, the adapter block 402 is configured with threads to engage corresponding structure on an x-ray device housing or other structure.

Further, the adapter block 402 may comprise any material (s) suitable for the intended application. Thus, in x-ray device applications for example, it may be desirable in some instances to employ materials that are electrical insulators and/or that attenuate x-rays. In at least some embodiments, the adapter block 402 substantially comprises metal, or a material doped with metal. In other cases however, materials such as plastics or ceramics are employed in the construction of the adapter block 402.

With continuing attention to FIG. 2, the exemplary adapter block 402 defines a fluid port 404 and a cylinder 406 in fluid communication with each other. Generally, the fluid port 404 enables the introduction of fluid into, and/or the removal of fluid from, the cylinder 406. The exemplary fluid port 404 is generally cylindrical in shape and takes the form of a female thread connection in FIG. 2. However, the fluid port may, more generally, be configured and/or arranged to mate with any of a variety of other types of fittings and components. Examples of such other fittings and components include, but are not limited to, welded or brazed fittings, quick disconnect fittings, compression fittings, and flange fittings.

In the illustrated implementation, the fluid port 404 is arranged at about ninety degrees with respect to the cylinder 406 while, in another exemplary embodiment, the fluid port 404 is disposed opposite, and substantially coaxial with, the cylinder 406. These are exemplary arrangements only however, and any other arrangement of comparable functionality may alternatively be employed.

Figure 3:
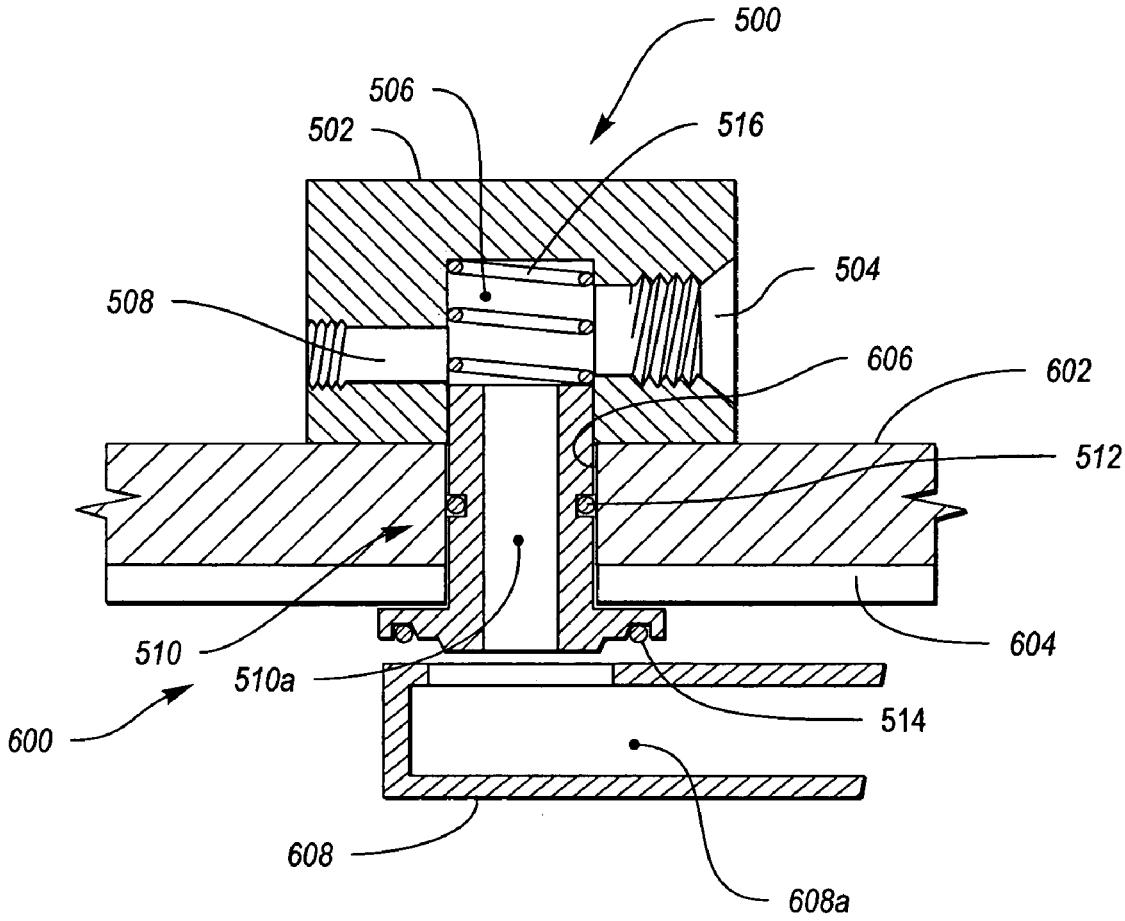
FIG. 3 is a partial section view illustrating details concerning the internal configuration of an exemplary fluid connection assembly as installed in an x-ray device.

The cylinder 406 is arranged to communicate with a corresponding opening in a structure such as the housing wall of an x-ray device (see FIG. 3). More specifically, the cylinder 406 is configured and arranged to slidingly accommodate a flow adapter, as discussed in further detail below. The cylinder 406 further serves to at least partially define a fluid path between a fluid source connected with the fluid port 404 and a component to which the fluid from the fluid source is to be communicated.

As further indicated in FIG. 2, at least some embodiments of the adapter block 402 define a pressure port 408. Similar to the fluid port 404, the configuration and arrangement of the pressure port 408 may be varied as desired. In this regard at least, the discussion of the fluid port 404 is largely germane to the pressure port 408 as well.

In some implementations, the pressure port 408 is configured and arranged to facilitate verification of flow through the fluid connection assembly 400. In one particular embodiment, a fluid connection assembly 400 is employed in connection with a pressure switch arranged so that flow through the fluid connection assembly 400 can be detected. Exemplary arrangements of a pressure switch employed to this end are disclosed and claimed in U.S. Pat. No. 6,366,642 (issued to Andrews), incorporated herein in its entirety by this reference. As discussed below however, the pressure port 408 may be employed to implement additional, or alternative, functionality as well.

It was noted earlier that, in addition to the pressure port 408 and fluid port 404, the adapter block 402 defines a cylinder 406 configured and arranged to slidingly accommodate a flow adapter. Directing continuing attention to FIG. 2, further details are provided concerning the configuration and arrangement of an exemplary flow adapter 410.

In general, the flow adapter 410 has a shape that complements the configuration of the cylinder 406 so that while the flow adapter 410 fits closely within the cylinder 406, the flow adapter 410 is nonetheless able to slide within the cylinder 406. It should be noted that in some instances, it may be useful to configure the flow adapter 410 and cylinder 406 in other than a cylindrical configuration, such as an oval, elliptical, or polygonal configuration for example.

As to the materials used in its construction, the flow adapter 410 may comprise a any suitable material(s), examples of which include, but are not limited to, metals, plastics, doped plastics and ceramics. Where a doped plastic is used, the doping material may comprise, for example, a metal oxide having a relatively high atomic number. More generally however, the construction material(s) for the flow adapter 410 will depend on considerations such as the particular nature of the application where the flow adapter 410 will be employed, and/or the nature, configuration and arrangement of the systems and devices with which the flow adapter 410 is used.

For example, if the flow adapter 410 is employed in an x-ray device, the flow adapter 410 may be required to comprise an electrically insulating material so that the flow adapter 410 is electrically isolated from the housing 101. In such applications, the flow adapter 410 may also be required to implement at least some attenuation of x-rays. Doped plastics are examples of materials with good electrical isolation and x-ray attenuation characteristics. However, any other material(s) of comparable functionality and characteristics may likewise be employed.

The exemplary flow adapter 410 illustrated in FIG. 2 includes a body 412 that defines a fluid passageway 414 configured to communicate with the fluid port 404 and the pressure port 408. The body 412 includes an adapter side 412A configured to be slidingly received in the cylinder 406, and an interface side 412B. As disclosed elsewhere herein, the interface side 412B generally aids in establishing fluid communication between the fluid connection assembly 400 and another component, such as a shield structure of an x-ray device for example.

The illustrated flow adapter 410 is configured so that the interface side 412B can engage, or otherwise interact with, a shield structure of an x-ray device. More generally, the particular configuration of the flow adapter is determined with reference to the particular device with which the flow adapter is intended to communicate. That is, the configuration of the flow adapter is such as to facilitate implementation of the functionality disclosed herein, with the result that such configuration may vary from one application and/or device to another. Accordingly, the illustrated configuration is exemplary only.

With continuing reference to FIG. 2, a sealing member 416, exemplified as an O-ring, is disposed about the body 412 and substantially prevents leakage of fluid between the cylinder 406 and the flow adapter 410. The sealing member 416 may comprise any material suitable for the intended application. Various types of rubber are examples of materials used in exemplary sealing members.

In addition to the sealing member 416, the exemplary flow adapter 410 also includes a sealing member 418 that substantially prevents leakage of fluid between the interface side 412B of the flow adapter 410 and the device with which the fluid connection assembly 400 interfaces. In some cases, the sealing member 418 may be omitted. For example, in certain x-ray device applications, the flow adapter interfaces with a shield structure or similar device, within the confines of a housing that contains a volume of coolant. Thus, limited leakage of coolant from the flow adapter would likely not present a problem since the leaked coolant would simply flow into the coolant already contained within the housing.

In order to assist the flow adapter 410 in interfacing with a shield structure or other device, exemplary embodiments of the fluid connection assembly 400 include a resilient element 420, such as a spring or other structure having comparable functionality. In the illustrated embodiment, the resilient element 420 is configured to be situated within the cylinder 406 above the flow adapter 410. Thus arranged, the resilient element 420 exerts a force on the flow adapter 410 that biases the flow adapter 410 into contact with the shield structure or other device with which the fluid connection assembly 400 is intended to interface. In this way, the resilient element 420 aids in ensuring a positive, reliable connection between the fluid connection assembly 400 and the shield structure or other device.

With respect to the positioning of the flow adapter 410 relative to the shield structure or other device, it was noted earlier that the pressure port 408 was not limited for use solely as a mechanism for detecting flow through the fluid connection assembly 400. More particularly, the pressure port 408 may also be employed to assist in verification of the proper positioning of the flow adapter 410. That is, a technician may, during assembly, verify that the resilient element 420 has properly positioned the flow adapter 410 by simply looking into the pressure port 408.

Specifically, some implementations of the fluid connection assembly 400 are configured so that if any portion of the flow adapter 410 is visible through the pressure port 408, the technician will know that the flow adapter 410 is not properly positioned and can take appropriate corrective action. Alternatively, some embodiments of the flow adapter included engraved markings or comparable features that, by virtue of their position and/or visibility, signify to personnel whether or not the flow adapter is in a desired position. As well, the pressure port can be fitted with a window, which may or may not be removable, which enables personnel to verify flow adapter positioning during operation of the x-ray system or other device.

III. Exemplary Arrangement of Fluid Connection Assembly and X-Ray Device

With attention now to FIG. 3, details are provided concerning the arrangement and use of an exemplary fluid connection assembly 500 in conjunction with an x-ray device 600. It should be noted that in order to facilitate the discussion, only selected portions of the x-ray device 600 are illustrated in FIG. 3. Moreover, as the discussion of the fluid connection assembly 400 elsewhere herein is largely germane to the exemplary fluid connection assembly 500, the following discussion will consider only selected aspects of the fluid connection assembly 500.

In the illustrated arrangement, the fluid connection assembly 500 includes an adapter block 502 that defines a fluid port 504, a cylinder 506 and a port 508, all of which are in communication with each other. A flow adapter 510 is partially disposed within the cylinder 506 and defines a fluid passageway 510A arranged for fluid communication with the fluid port 504, cylinder 506 and port 508. The flow adapter 510 also includes a pair of sealing elements 512 and 514 that serve to prevent, or at least limit, leakage of fluid when the flow adapter 510 is operably positioned. In addition to the flow adapter 510, a resilient element 516 is also positioned in the cylinder 506 and acts to bias the flow adapter 510 into a desired position, as discussed in further detail below.

As indicated in FIG. 3, the fluid connection assembly 500, specifically, the adapter block 502, is mounted to a housing wall 602 of the x-ray device 600. In this exemplary implementation, a layer of x-ray attenuation material 604 is attached to at least a portion of the interior of the housing wall 602. The housing wall 602 and the layer of x-ray attenuation material 604 collectively define an opening 606 about which the adapter block 502 is mounted and within which the flow adapter 510 of the fluid connection assembly 500 is at least partially received. Thus arranged, the flow adapter 510 is capable of a range of motion within the passageway collectively defined by the cylinder 506 and the opening 606.

In the illustrated implementation, the range of motion of the flow adapter 510 is at least partially defined by a shield structure 608 of the x-ray device 600. In particular, the shield structure 608 defines a fluid passageway 608A that is open at one end and positioned to receive, or otherwise interface with, the flow adapter 510. Thus, the action of the resilient element 516 biases the flow adapter 510 into contact with the shield structure 608 so that the fluid passageway 510A of the flow adapter is brought into communication with the fluid passageway 608A of the shield structure 608.

In this regard, the resilient element 516 is typically selected with a spring constant adequate to reliably maintain the flow adapter 510 in substantial contact with the shield structure 608 over a range of operating conditions. Additionally, in biasing the flow adapter 510 to a desired position, the resilient element 516 provides a measure of compensation for differences in x-ray device configurations, and shield structure configurations and arrangements.

In operation, coolant introduced into the fluid connection assembly 500 by way of the port 504 passes into the cylinder 506 and through the fluid passageway 510A of the flow adapter 510. In at least some instances, the pressure port 508 is plugged, so that no coolant passes through the pressure port 508. In any case, the coolant then exits the fluid passageway 510A and enters the shield structure 608 by way of the fluid passageway 608A. As the coolant flows through the shield structure 608, heat present in the shield structure 608 as a result of the impact of back scattered electrons is removed by the flowing coolant. Depending upon the configuration of the shield structure 608, the heated coolant then either returns directly to an external cooling system (see FIG. 1), or is returned to the interior of the x-ray device housing and, later, to an external cooling system.

Among other things then, the configuration and arrangement of the fluid connection assembly obviates the need for a multiplicity of fluid components and connections. Additionally, the fluid connection assembly is of a simple and rugged design that is well suited to withstand the rigors of x-ray device operating conditions while also providing consistent and reliable service.

The described embodiments are to be considered in all respects only as exemplary and not restrictive. The scope of the invention is, therefore, indicated by the appended claims rather than by the foregoing description. All changes which come within the meaning and range of equivalency of the claims are to be embraced within their scope.

What is claimed is:

1. A fluid connection assembly suitable for use with an x-ray device, the fluid connection assembly comprising:

an adapter block configured to be attached about an opening in a housing wall of the x-ray device, the adapter block defining a fluid port and a cylinder in fluid communication with each other;

a flow adapter configured to be received in a passageway at least partially defined by the cylinder of the adapter block and the opening in the housing wall, and the flow adapter defining a fluid passageway configured for communication with the fluid port and the cylinder when the flow adapter is at least partially received within the cylinder;

a resilient element positioned in the cylinder and arranged to bias the flow adapter into a desired position; and a sealing element disposed about the flow adapter and arranged for contact with a wall of the passageway at least partially defined by the cylinder of the adapter block and the opening in the housing wall.

2. The fluid connection assembly as recited in claim 1, wherein at least a portion of the fluid port is threaded.

3. The fluid connection assembly as recited in claim 1, wherein the adapter block further defines a pressure port in communication with the fluid port, cylinder, and fluid passageway of the flow adapter.

4. The fluid connection assembly as recited in claim 1, wherein the flow adapter comprises a material that is substantially non-electrically conductive.

5. The fluid connection assembly as recited in claim 1, wherein the flow adapter substantially comprises at least one of: ceramic; plastic; and, plastic doped with a refractory metal.

6. The fluid connection assembly as recited in claim 1, wherein the flow adapter substantially comprises at least one of: ceramic; plastic; and, plastic doped with a non-refractory metal.

7. The fluid connection assembly as recited in claim 1, wherein the flow adapter includes an interface portion configured to engage corresponding structure of a component of the x-ray device.

8. The fluid connection assembly as recited in claim 1, further comprising a sealing element arranged to be interposed between a portion of the flow adapter and corresponding structure of a component of the x-ray device.

9. An x-ray device, comprising:

an x-ray tube;

a housing within which the x-ray tube is substantially positioned, the housing having a wall that defines an opening;

a component disposed within the housing and defining a fluid passageway; and a fluid connection assembly, comprising:

an adapter block configured to be attached about the opening in the housing wall, the adapter block defining a fluid port and a cylinder in fluid communication with each other;

a flow adapter configured to be received in a passageway at least partially defined by the cylinder of the adapter block and the opening in the housing wall, and the flow adapter defining a fluid passageway configured for communication with the fluid port and the cylinder; and a resilient element positioned in the cylinder and arranged to bias the flow adapter into contact with the component so that the fluid passageway of the component is in fluid communication with the fluid passageway defined by the flow adapter.

10. The x-ray device as recited in claim 9, wherein the x-ray device comprises an anode end grounded x-ray device.

11. The x-ray device as recited in claim 9, wherein the component comprises a shield structure.

12. The x-ray device as recited in claim 9, wherein the adapter block further defines a pressure port in communication with the fluid port, cylinder, and fluid passageway of the flow adapter.

13. The x-ray device as recited in claim 9, wherein the flow adapter comprises a material that is substantially non-electrically conductive.

14. The x-ray device as recited in claim 9, wherein the flow adapter substantially comprises at least one of: ceramic; plastic; and, plastic doped with a refractory metal.

15. The x-ray device as recited in claim 9, wherein the flow adapter substantially comprises at least one of: ceramic; plastic; and, plastic doped with a non-refractory metal.

16. The x-ray device as recited in claim 9, further comprising a sealing element disposed about the flow adapter and arranged for contact with a wall of the passageway at least partially defined by the cylinder of the adapter block and the opening in the housing wall.

17. The x-ray device as recited in claim 9, further comprising a sealing element interposed between a portion of the flow adapter and the component.

18. The x-ray device as recited in claim 9, further comprising a pressure switch in communication with a pressure port defined by the adapter block, the pressure switch being configured and arranged to facilitate verification of fluid flow within the fluid connection assembly.

* * * * *